United States Patent [19]

Van Berk et al.

[11] Patent Number: 4,470,208

[45] Date of Patent: Sep. 11, 1984

[54] DREDGE WITH ADJUSTABLE BOTTOM SUPPORT FOR SUCTION PIPE AND METHOD

[76] Inventors: Hendrikus Van Berk, H. Govertkade 3, 2628 EA Delft; Jan Brouwer, Goudenregenstraat 46, Vianen, both of Netherlands

[21] Appl. No.: 435,117

[22] Filed: Oct. 19, 1982

[30] Foreign Application Priority Data

Oct. 22, 1981 [NL] Netherlands ..... 8104791

[51] Int. Cl.[3] ..... E02F 3/88

[52] U.S. Cl. ..... 37/63; 37/58; 37/72; 37/195

[58] Field of Search ..... 37/58, 61, 62, 63, 195, 37/56, 72

[56] References Cited

U.S. PATENT DOCUMENTS

| | | | |
|---|---|---|---|
| 687,830 | 12/1901 | Kirk | 37/56 X |
| 842,364 | 1/1907 | White | 37/61 |
| 2,146,790 | 2/1939 | Brewer | 37/62 |
| 2,599,980 | 6/1952 | Dunning | 37/62 |
| 2,711,598 | 6/1955 | Craggs, Jr. | 37/62 |
| 2,995,842 | 8/1961 | Korste | 37/58 |
| 3,153,290 | 10/1964 | Saito | 37/62 |
| 3,311,414 | 3/1967 | Cannon, Sr. et al. | 37/58 X |
| 3,611,595 | 10/1971 | DeKoning | 37/58 |
| 3,681,862 | 8/1972 | DeKoning et al. | 37/58 |
| 3,756,659 | 9/1973 | DeKoning | 37/58 |
| 3,772,805 | 11/1973 | DeKoning | 37/58 |
| 3,909,960 | 10/1975 | Casciano | 37/63 |

FOREIGN PATENT DOCUMENTS

| | | | |
|---|---|---|---|
| 459568 | 9/1949 | Canada | 37/58 |
| 1802158 | 6/1969 | Fed. Rep. of Germany | 37/58 |
| 1403852 | 5/1965 | France | 37/61 |
| 6510377 | 2/1967 | Netherlands . | |
| 6617592 | 6/1967 | Netherlands . | |
| 6609299 | 1/1968 | Netherlands . | |
| 6714009 | 4/1969 | Netherlands . | |
| 8001714 | 10/1981 | Netherlands . | |
| 309101 | 4/1929 | United Kingdom . | |

*Primary Examiner*—Clifford D. Crowder

*Attorney, Agent, or Firm*—Leydig, Voit, Osann, Mayer and Holt, Ltd.

[57] ABSTRACT

Method for suctioning submerged bottom material with the aid of at least a suction pipe connected to a vessel, whereby said suction pipe is lowered from said vessel in an inclined or vertical position and an underpressure is created in said suction tube for suctioning a mixture of bottom material and water through the tube via one or more suction openings near the lower side of the suction tube. The lower part of the suction tube is forced over a certain distance into the bottom such that during suctioning of the mixture of bottom material and water always at least a part of the weight of the suction tube is carried by the bottom material, e.g. by a supporting surface formed in said bottom material. The suction tube is at least in longitudinal direction anchored, and the mixture of bottom material and water is suctioned by transversal openings in the suction tube at a distance from this supporting surface.

18 Claims, 18 Drawing Figures

DREDGE WITH ADJUSTABLE BOTTOM SUPPORT FOR SUCTION PIPE AND METHOD

The invention relates in the first place to a method for suctioning submerged bottom material with the aid of at least a suction tube connected to a vessel, whereby the suction tube is lowered from the vessel in an inclined or vertical position, and a reduced pressure or partial vacuum is created in the suction tube for suctioning a mixture of bottom material and water through the tube via one or more suction openings near the lower side of the suction tube, whereby eventually the suction openings are gradually lowered under the bottom surface such that, by suctioning the bottom material, an excavation or trough is formed in the bottom. Such a method is described in the article "A suction dredger in said pits" in "Civil Engineering and Public Works Review", April 1970, Vol. 65, No. 765, pages 403–405.

The major problem in this known method is to maintain the suction opening (s) at the most favourable distance from the vessel to the bottom material under swell and wave conditions. If the distance is too large then a mixture of bottom material and a relatively large volume of water is suctioned, so that the transport concentration decreases, whereas with too small a distance the suction opening becomes clogged so that it is not possible to suction any mixture of bottom material and water. Therefore, complicated swell compensators and positioning systems are used in the known method to maintain a constant distance between the suction opening(s) and the bottom material. Notwithstanding these measures it is not possible to use this method under heavy wave conditions.

The present invention is to create a method of the above-mentioned type whereby said disadvantages are eliminated.

Said object is reached with the method according to the invention in that the lower part of the suction tube is forced over a certain distance or depth into the bottom, such that during suctioning of the mixture of bottom material and water always at least a part of the weight of the suction tube is carried by the bottom material, e.g. by a supporting surface formed in the bottom material, and the suction tube is anchored at least in a direction corresponding to the longitudinal axis of the suction tube, and the mixture of bottom material and water is suctioned through openings in the suction tube near the lower end thereof at a distance from the supporting surface.

In this way the suction tube is in fact anchored in the bottom, whereby an increasing depth of this anchorage results in an improved anchorage in the transverse direction, so that in this anchored situation the suction opening(s) can always be situated in the most favourable position for suctioning the bottom material, and only a very simple swell compensator and eventually a simplified positioning system is sufficient.

Because in the method according to the invention the suction tube is supported by the bottom material, the vessel can also be supported by the bottom. Therefore advantageously the vessel is submerged until below the water level, because it is not necessary that the vessel float at a certain level under the water surface. In this way the vessel is for the most part not influenced by water and wind so that the use of a swell compensator is completely superfluous, whereas the vessel with the suction tube can be submerged to any favourable suction depth. Furthermore, the created underpressure can be used in an optimal way.

For the purpose of forcing the lower part of the suction tube into the bottom or forcing said part further downwards a pressurized fluid can be sprayed through openings in or near the bottom or head side of the suction tube into the bottom material.

In this way the consistency of the bottom material underneath and around the supporting surface is broken by the fluid jets and/or fluidized and suctioned up, so that as a result of the force exerted onto the bottom through the suction pipe said pipe descends until the pressurized fluid jets are interrupted, whereafter in consistent types of soil again directly a supporting surface is present, or the bottom material underneath the lower end of the suction tube is directly conslidated and forms a supporting surface of the suction tube.

In relation with the spraying of a pressurized fluid or separate therefrom, a reduced pressure can be created near the lower end of the lower part of the suction tube, which reduced pressure is preferably derived from the reduced pressure created in the suction tube.

Because of the reduced pressure the bottom material in the neighbourhood of the supporting surface is directly suctioned away, causing the suction tube to descend until the generation of the underpressure is stopped.

The invention, furthermore, relates to a system for carrying out the method comprising a vessel and a thereto connected suction tube having an open lower end, means for lowering the suction tube and means for creating an underpressure in the suction tube, whereby according to the invention underneath the open lower end of the suction tube a supporting means is positioned attached to the suction tube and there is an open connection between the open lower end of the suction tube and the exterior of the suction tube via one or more transverse passages.

Preferably the vessel can be embodied as an underneath the water surface submergible vessel, such that the suction tube supported by the aid of the supporting means on the bottom additionally supports the vessel.

In this way the suction tube can be embodied as one integral piece of tubing or predetermined length eliminating the necessity of using articulated of telescoping tube sections with hoisting cables as in the known systems, necessary for bringing the suction openings in the tube to a deeper level. Furthermore, the means for generating an underpressure can be installed at an optimal distance from the suction openings, because the distance between the suction openings and the vessel is constant and independent of the suction depth.

The distance between the lower edge of the suction tube and the supporting means can be adjustable, whereby preferably the adjustment is realized in that a tube section is slidable around or inside at least the lower part of the suction tube and there are means to extend or retract said tube section such that in the extended situation a part of this tube section is positioned outside the suction tube embodying an elongation thereof.

In this way it is possible to suction the bottom material around and underneath the lower side of the supporting means directly, so that the suction tube can descend to a deeper level.

The supporting means can be connected to the suction tube by the aid of elongated members such as rods, pipe segments or similar means such that the spaces between the means form transverse openings or passages.

Preferably the pipe sections form thereby the supply conduits for supplying a pressurized fluid to one or more chambers, formed into the supporting means, whereby the chamber comprises openings for spraying fluid jets into the bottom.

By means of the fluid jets the bottom material around the supporting means can be crumbled and/or fluidized and can be suctioned off, so that the suction tube can descend to a deeper level.

The suction tube can be embodied as a tube having a double wall, whereby the abovementioned pipe sections are with their upper ends inserted into the annular space between said walls.

It is also possible that the supporting means is connected to the suction tube with the aid of axially extending wall parts such that the spaces between the wall parts define the transversal openings.

Both walls of the suction tube in the embodiment in which the tube has a double wall, extend in the axial direction to reach the supporting means, whereby in both extension walls opposed openings are made. Preferably, the bottom edges of these openings in the inner extension wall are positioned lower than the bottom edges of the openings in the outer extension wall.

It is remarked that from the French Pat. No. 1,403,852 a method for suctioning submerged bottom material by means of a suction tube is known, according to which method the lower end of the suction tube is forced over a certain distance into the bottom and a water stream is created flowing from the exterior to the interior along and underneath the lower edge of the suction tube, which water stream is not generated continuously but intermittently. The side wall of the suction tube can have sideward directed openings, but the purpose of this is exclusively to create an additional water stream for eroding the bottom material which is in the form of a core present in the lower part of the suction tube for which reason the sideward directed openings should be positioned as close as possible to the bottom edge.

The invention is now described in detail with reference to the drawings in which embodiments of the invention are illustrated and with reference to which the functioning of the invention with bottom material, e.g. mainly consisting of sand, is explained.

FIGS. 6*a*–6*f* explain as example some successive steps during the execution of the method.

Figure 7:
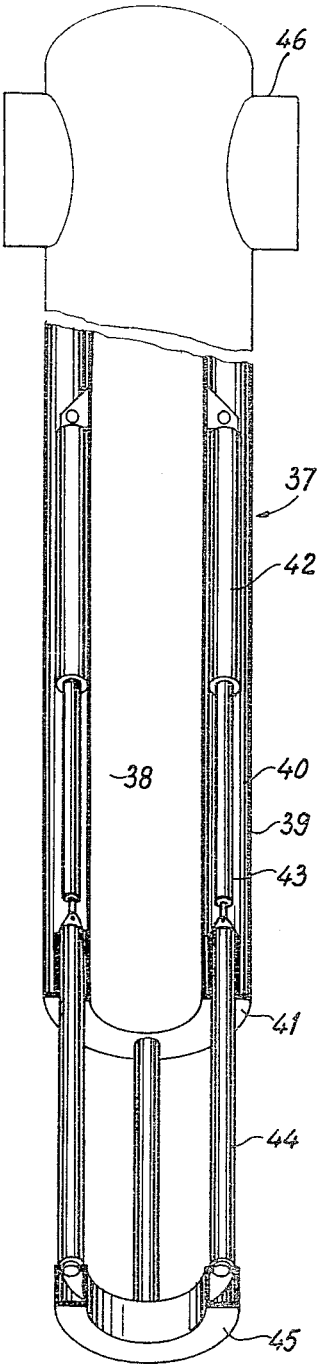

FIG. 7 illustrates on a larger scale an embodiment of the suction tube.

Figure 8:
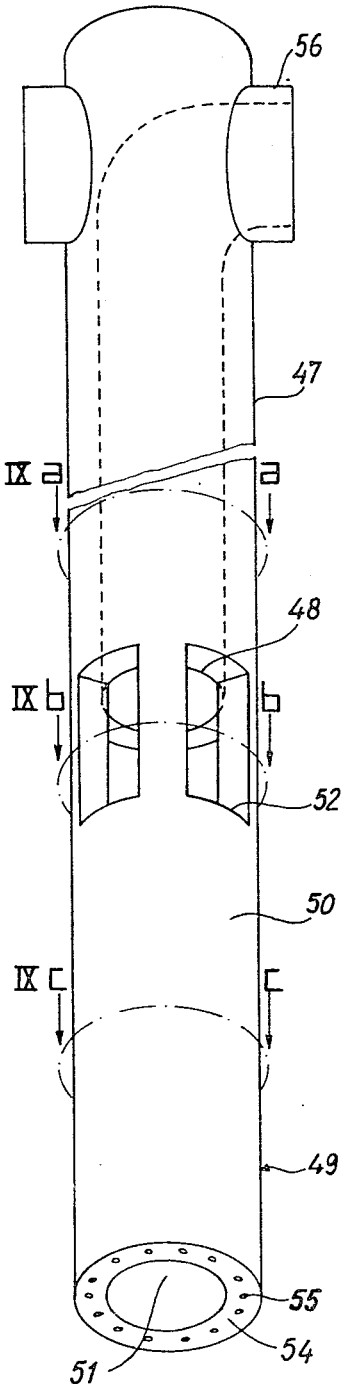

FIG. 8 shows another embodiment of the suction tube.

Figure 9A:
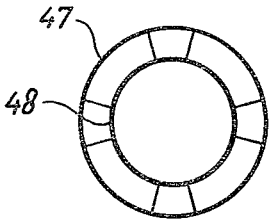
Figure 9B:
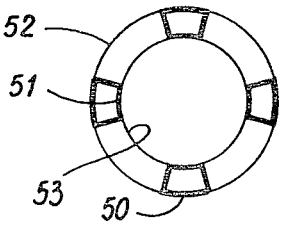
Figure 9C:
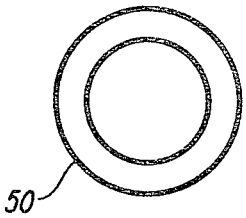

FIG. 9 shows cross-sections in the planes IXa, IXb and IXc in FIG. 8.

Figure 10:
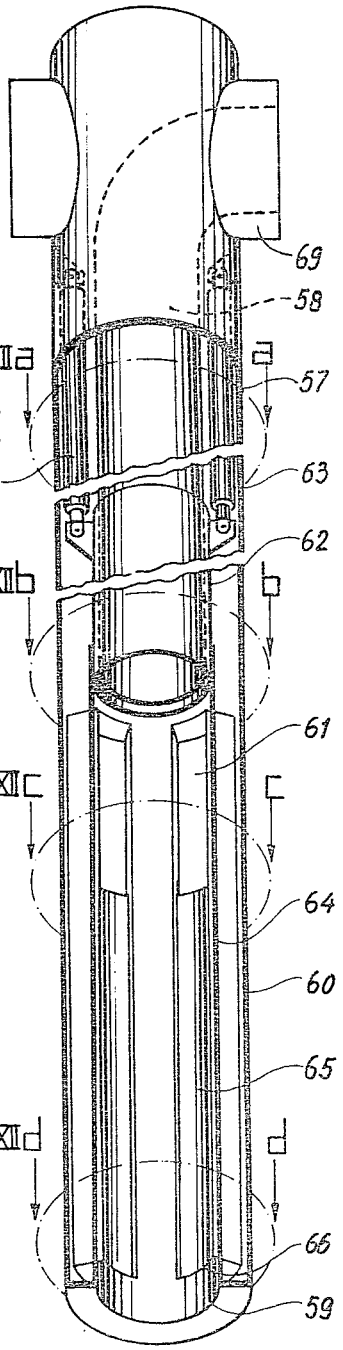
Figure 11:
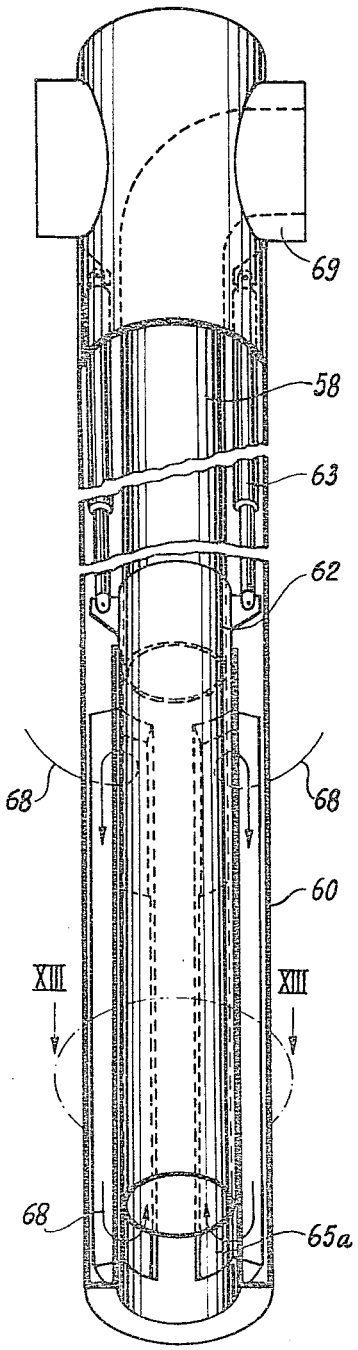
Figure 12A:
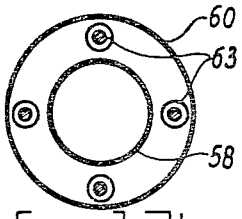
Figure 12B:
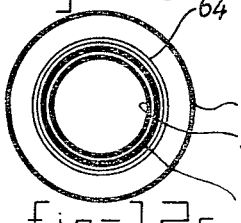
Figure 12C:
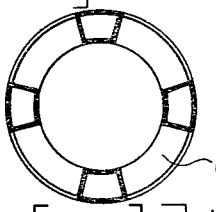
Figure 12D:
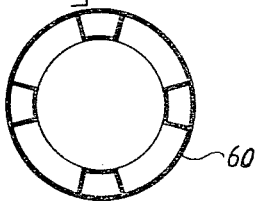

FIGS. 10 and 11 show a further embodiment of the suction tube, partly in longitudinal cross-section.

FIG. 12 shows cross-sections through the planes XIIa, XIIb and XIIc and XIId in FIG. 10.

Figure 13:
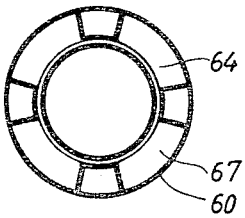

FIG. 13 illustrates a cross-section according to XIII in FIG. 11.

Figure 1:
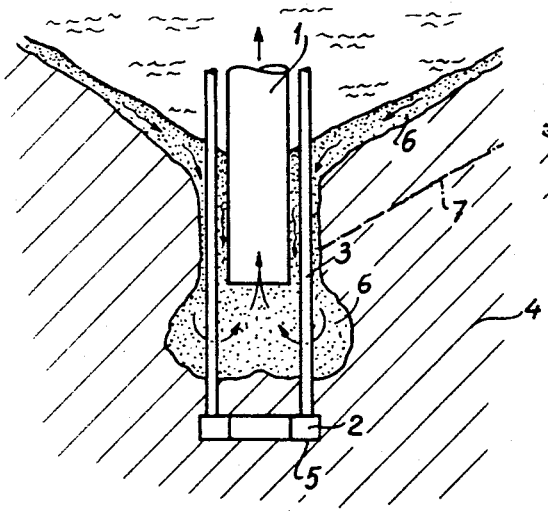
FIGS. 1 and 2 show schematically a first embodiment of the suction tube according to the invention.

As is shown in FIG. 1 an annular supporting means 2 is installed beneath the lower end of the suction tube or pipe 1, which supporting means through rods or pipe sections 3 is connected to the suction tube in a way, not illustrated in detail, and the suction tube can be moved upwards and downwards in relation to the supporting means. The supporting means 2 is already forced into the bottom 4, so that the supporting means and therewith also the suction tube is carried by the supporting surface 5. By generating a reduced pressure or an underpressure in the suction tube a mixture 6 of bottom material, in general sand and water, is suctioned through the spaces between the pipe sections 3 to and through the suction pipe.

Figure 2:
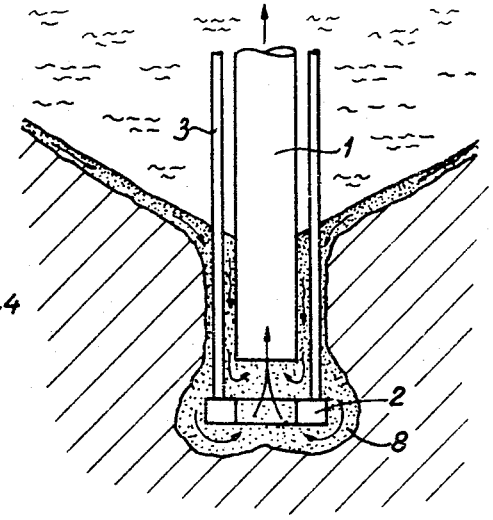

After a certain amount of sand is suctioned in this way, e.g. until a bottom profile 7 is reached it will be necesssary for further suctioning that the supporting means is brought to a deeper level, for which purpose, as is illustrated in FIG. 2, the suction pipe is brought closer to the supporting means 2, so that near this supporting means an underpressure or partial vacuum is created and the bottom material in the neighbourhood of this means is fluidized and suctioned off as is illustrated with 8 in FIG. 2, so that the supporting means with the suction tube will descend to a lower level. After removing the underpressure near the supporting means 2 the supporting means will consolidate itself onto the surrounding bottom material, so that again a supporting surface is formed and the suctioning of bottom material can proceed after the suction tube is raised again in relation to the supporting means.

Figure 3:
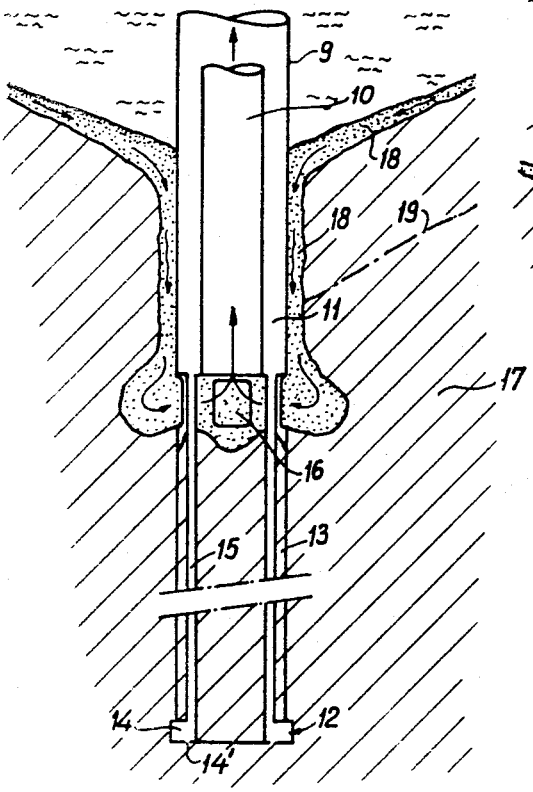
FIGS. 3 and 4 show schematically a second embodiment of the suction tube according to the invention.
Figure 4:
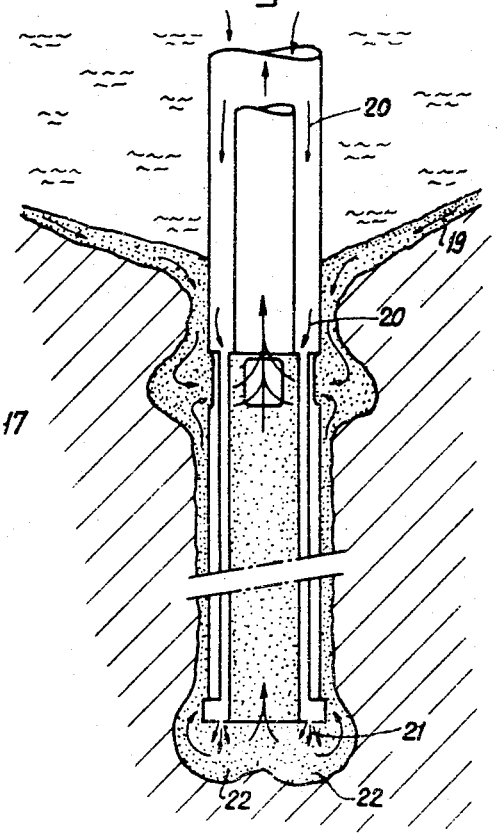

In the embodiment illustrated in FIGS. 3 and 4 the suction tube comprises an outer tube 9 and an inner tube 10 forming an annular chamber 11 connected in the not-illustrated upper section of the suction tube with a pressurized fluid supply means. The supporting means 12 is connected through an elongated wall part 13 of the outer tube 9 to the suction tube, whereas the supporting means 12 comprises an annular chamber 14 having downward directed nozzles 14', which chamber 14 by means of the pipe sections 15 is connected to the annular chamber 11. In the wall 13 furthermore a number of openings 16 are made through which openings 16 the lower part of the suction tube 9, 10 communicates with the exterior.

In FIG. 3 the supporting means 12 is already forced into the bottom 17 through a relatively large distance, so that the supporting means and therewith also the suction tube is supported by the bottom resulting in a proper anchorage in the horizontal direction. If an underpressure is generated in the suction tube, then a mixture 18 of sand and water is suctioned through openings 16 to and through the suction pipe.

If after some time, e.g. when the bottom profile 19 is reached, the supporting means 12 should be brought to a deeper level, then a pressurized fluid is supplied to the annular chamber 11, from which said fluid flows through the pipe sections 15 into the annular chamber 14 of the supporting means 12, from which chamber it is sprayed through the nozzles 14' into the surrounding bottom material as is illustrated in FIG. 4 by the arrows 20 and 21. In this way the bottom material around the supporting means 12 is fluidized as is illustrated at 22, and suctioned away through the suction pipe, so that the supporting means together with the suction pipe will descend to a lower level.

If the spraying of pressurized fluid through the openings 14' is thereafter stopped, then the supporting means will consolidate itself onto the surrounding bottom material, so that again a supporting surface for the suction tube is formed.

Figure 5:
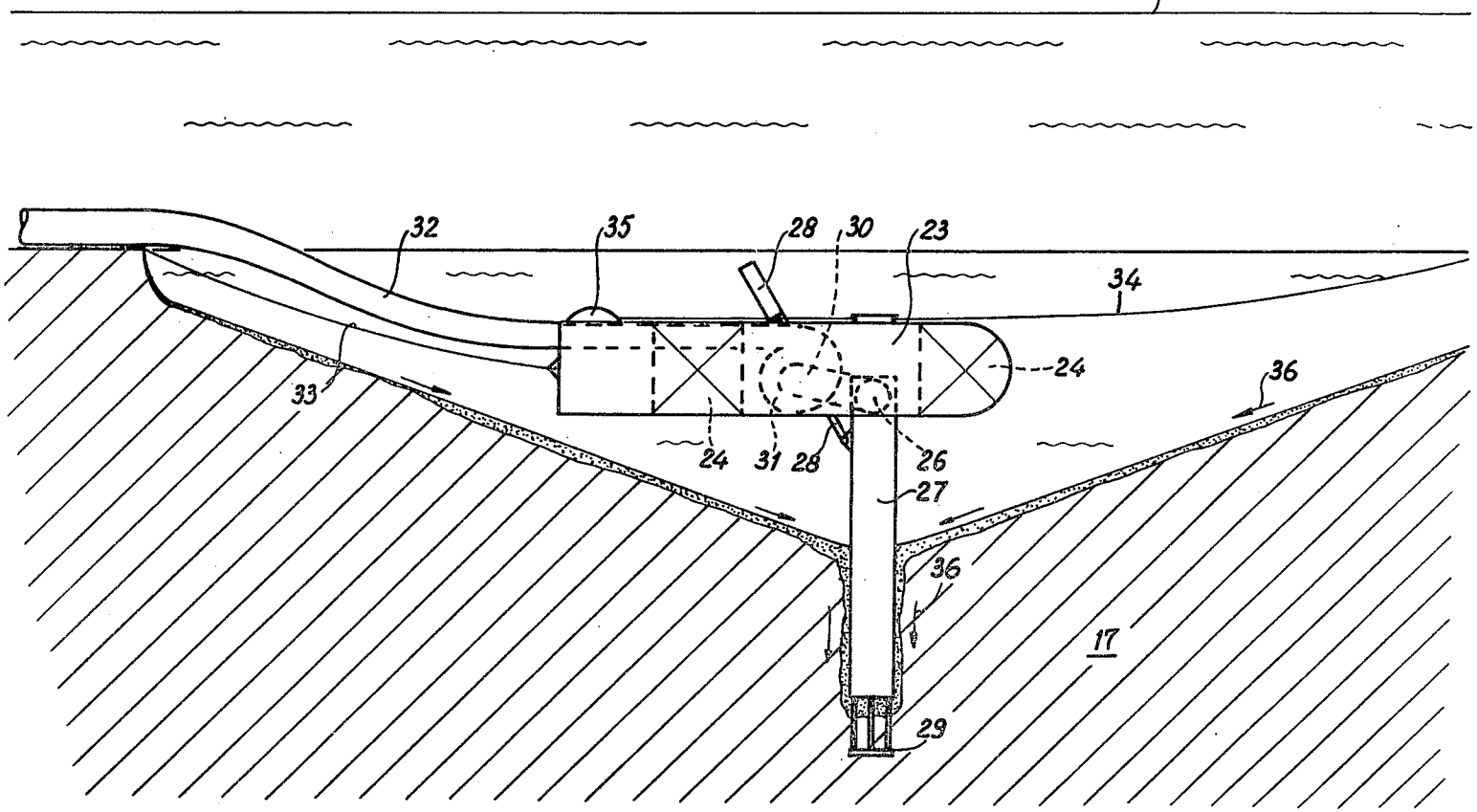
FIG. 5 illustrates schematically an embodiment of the whole system according to the invention.

As is illustrated in FIG. 5 the suction dredging system comprises a vessel 23, for instance embodied as a pontoon comprising ballast tanks 24 for controllably submerging said vessel as is illustrated by the position of the vessel in relation to the water surface 25. At 26 a suction tube 27 is pivotably connected to the vessel, which suction tube by means of a piston/cylinder combination 28 can be moved from a position parallel to the vessel in a position in which said suction tube is extends perpendicularly downwards. The suction tube carries at its bottom end a supporting means 29, whereas the upper end of the suction tube is through a pipe section 30 connected to the suction side of a pump 31, of which the pressuring side is connected to a pressure pipe 32 running to a not illustrated in detail location, where the suctioned bottom material is delivered. Furthermore, the vessel comprises anchoring means such as a cable 33 running e.g. to an anchoring point on dry land and a cable 34 running from a winch 35 e.g. to an anchoring buoy.

As is illustrated in FIG. 5 the suction tube 27 is forced into the undisturbed bottom 17 by submerging the vessel over a certain distance, such that the suction tube and the vessel is supported on the bottom by the bottom of the supporting means 29, whereby during the functioning of the system the bottom material moves according to the arrows 36 and is suctioned through the open bottom end of the suction tube in and through the suction tube and is passed thereafter through the pressure conduit.

In FIG. 6 several stages are schematically indicated during the functioning of the system in shallow water, according to FIG. 5. In FIG. 6*a* the vessel 23 has arrived at its place of destination.

Figure 6A:
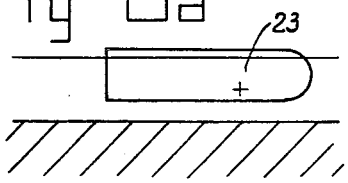
Figure 6D:
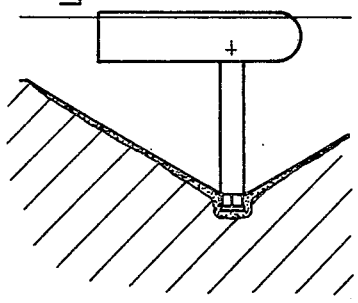
Figure 6B:
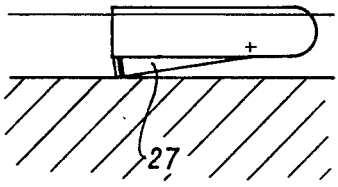
Figure 6E:
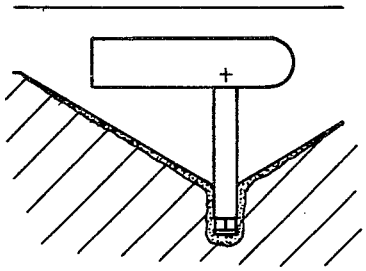
Figure 6C:
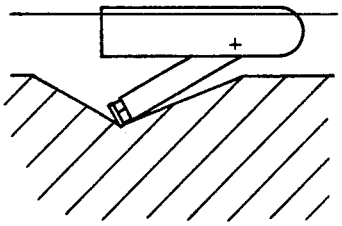

FIG. 6*b* illustrates how the suction tube 27 is lowered onto the bottom and is supported by said bottom, whereafter the suctioning of bottom material is started during which procedure the suction tube 27 is gradually rotated downwards as is illustrated in FIG. 6*c* and forms thereby an excavation in the bottom material.

In FIG. 6*d* the suction tube 27 has reached a downward extending position in relation to the vessel, so that for further and deeper suctioning of bottom material the vessel should be submerged as is illustrated in FIG. 6*e*.

Figure 6F:
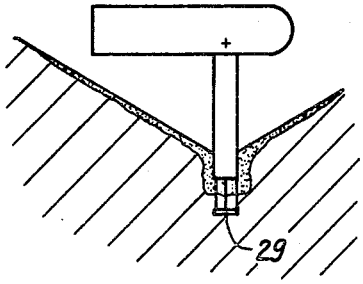

In FIG. 6*f* the supporting means 29 is forced deeper into the bottom to create a supporting surface at a deeper level such that the suctioning of bottom material can proceed by a system supported on the bottom.

As is illustrated in FIG. 7 the suction tube 37 comprises an inner tube 38 and an outer tube 39, coaxially positioned at a distance from each other such that an annular space 40 between said tubes is formed which space is closed at the underside of the suction tube by the ring 41.

In the annular spaced space 40 a number, e.g. four, piston/cylinder units 42 are installed of which the piston rods 43 are connected to the pipe sections 44, which pipe sections 44 are slidably guided through openings in the ring 41. At their bottom ends the pipe sections 44 are connected to the annular supporting means 45, such that by controlling the piston/cylinder units 42 the distance between said supporting means 45 and the bottom end of the suction tube 37 coinciding with the ring 41 can be altered.

The suction tube is, by means of axles 46, pivotably connected to the vessel.

In the FIGS. 8 and 9 an embodiment of the suction tube is illustrated. Said suction tube comprises an outer tube 47 and, coaxially therewith at some distance inwards, the inner tube 48, functioning as the real suction tube. The annular spaced supporting means 49 is connected through elongated wall sections 50, 51 of the respective outer and inner tube connected to said tubes. In said elongated wall sections 50, 51 a number of opposed openings or windows 52, 53 respectively are made. Openings 55 are made in the lower surface 54 of the supporting means 49 and through said openings a pressurized fluid can be sprayed, which fluid is supplied via the annular shaped space between the inner and outer tubes 48, 49 and between the extension walls 51, 50.

The suction tube in the FIGS. 10, 11 and 12 and 13 comprises furthermore an outer tube 57 and coaxially at some distance inwards the inner tube 58 forming the real suction tube, whereas the annular supporting means 59 is connected through the elongated wall 60 to the outer tube of said suction pipe, and in said elongated wall 60 a number of openings 61 are made. A slidable tube section 62 is installed around said inner tube which can be made to slide by controlling the piston/cylinder combinations 63 installed in the annular space between the outer tube 57 and the inner tube 58, with the result that the slidable tube 62 can be moved from the highest position illustrated in FIG. 10 to the lowest position illustrated in FIG. 11 and vice versa.

The slidable tube 62 is thereby guided because said tube is moving within the guiding tube 64 of which the bottom end is attached to the supporting means 59. In the wall of said guiding tube 64 openings 65 are made opposite the openings 61 in the extension wall 60, but having an enlarged length dimension in relation to said openings 61 so that the bottom edges 66 of the openings 65 are situated near the supporting means 59.

If the slidable tube is in its lowest position as is illustrated in FIG. 11 then the slidable tube completely overlaps the openings 61 in the extension wall 60 at some intermediate distance and the openings 65 in the guiding tube 62 are overlapped for the major part so that a relatively small part 65*a* of the openings 65 above their bottom edges 66 is left uncovered. The result thereof is that downward guiding channels 67 are formed between the extension wall 60 of the outer tube 57 and the guiding tube 64, which through the openings 61 at the upper side are communicating with the exterior and through the openings 65*a* and through the slidable tube 57 are communicating with the real suction tube 58.

By moving the slidable tube 62 to the lower position in fact the reduced pressure generated in the real suction tube 58 is transmitted to a position near the supporting means, so that in that case water from the exterior is suctioned through the channels 67 and flows in downwards direction as is illustrated with the arrows 68, and these water streams are able to fluidize and/or crumble the bottom material around and underneath the supporting means so that the suction tube can descend to a lower level.

The suction tube is through the axles 69 pivotably connected to the vessel.

We claim:

1. System adapted to be used with a vessel for suctioning submerged bottom material from a subaqueous environment comprising a suction tube having an open lower end, means for lowering the suction tube, means for communicating said suction tube to the vessel and means for creating reduced pressure in the suction tube wherein underneath said open lower end of the suction tube a means for supporting the suction tube in an operative state on a supporting surface is positioned attached to the suction tube, said suction tube having at least one transverse passage communicating between said open lower end of the suction tube and the exterior of the suction tube and means for varying the distance between said supporting surface and the open lower end of said suction tube.

2. System according to claim 1 comprising means for forcing the open lower end of the suction tube deeper into the bottom, including a means for submerging the vessel below the surface of the water.

3. System according to claim 2 wherein a tube section is provided in the lower section of the suction tube, said tube section slidable along said suction tube and means are present for extending or retracting said tube section such that in the extended position a part of the tube section projects from the suction tube and forms an elongation thereof.

4. System according to claim 1, wherein the means for generating a reduced pressure are located between the open lower end of the suction tube and the vessel.

5. System according to claim 1, wherein the distance between the lower end of the suction tube and the supporting means is adjustable.

6. System according to claim 1, wherein the supporting means is connected to the suction tube by elongated members so as to define transverse openings between said elongated members.

7. System according to claim 1, wherein the supporting means comprise axially extending wall sections connected to said suction tube such that the spaces between said wall sections form transverse openings.

8. System according to claim 1, wherein the supporting means comprise one or more chambers and have openings communicating with said chambers, said system further including at least one supply conduit for supplying a pressurized fluid to said chambers.

9. System according to claim 8, wherein the supply conduits are formed as pipe sections, which pipe sections form part of said supporting means.

10. System according to claim 1, wherein the suction tube is embodied as a tube having a double wall.

11. System according to claim 10, wherein both walls of the double wall are elongated in the axial direction up to the supporting means and both of said walls have openings therein.

12. System according to claim 11, wherein the lower edges of said openings in the inner of said walls are situated at a lower level than the lower edges of the openings in the outer extension wall.

13. System according to claim 10, wherein said supporting means comprise pipe sections, the upper ends of which extend into the annular space between the suction tube walls.

14. Method for suctioning submerged bottom material from a subaqueous environment with the aid of a suction tube connected to a vessel, whereby said suction tube is lowered from said vessel and completely submerged in a downward extending position and suction is created in said suction tube for suctioning a mixture of bottom material and water through the tube by means of at least one opening near the lower end of the suction tube, said method comprising the steps of:

(a) forcing the lower portion of the suction tube through a certain depth into the bottom such that during suctioning of the mixture of bottom material and water always at least a part of the weight of the suction tube is carried by a supporting surface formed in said bottom material, and the suction tube is anchored at least in a direction corresponding to the longitudinal axis of the suction tube, (b) suctioning a mixture of bottom material and water through said at least one suction opening in the suction tube near the lower end thereof at a distance from said supporting surface, and (c) decreasing the distance between said supporting surface and at least one suction opening, such that said at least one suction opening is lowered below the surface of the bottom and, by suctioning the bottom material, an excavation or trough is formed in the bottom.

15. Method according to claim 14, wherein for the purpose of forcing the lower part of the suction tube into the bottom, the vessel is submerged until below the water level.

16. Method according to claim 14 wherein for the purpose of forcing the lower part of the suction tube into the bottom, a pressurized fluid is sprayed through openings in or near the bottom end of the suction tube into the bottom material.

17. Method according to claim 14 wherein for the purpose of forcing the lower part of the suction tube into the bottom a reduced pressure is created near the lower end of said lower portion of the suction tube.

18. Method according to claim 17, wherein said reduced pressure is derived from the reduced pressure created in said suction tube.

* * * * *